United States Patent [19]

Hornblad

[11] Patent Number: 4,937,962

[45] Date of Patent: Jul. 3, 1990

[54] DISPLAY BANNER

[75] Inventor: Richard P. Hornblad, Shorewood, Wis.

[73] Assignee: DCI Marketing, Milwaukee, Wis.

[21] Appl. No.: 406,195

[22] Filed: Sep. 13, 1989

Related U.S. Application Data

[63] Continuation of Ser. No. 348,152, May 2, 1989, abandoned, which is a continuation of Ser. No. 64,330, Jun. 19, 1987, abandoned.

[51] Int. Cl.[5] ..... G09F 19/00

[52] U.S. Cl. ..... 40/617; 40/604; 40/615

[58] Field of Search ..... 40/10 D, 159, 405, 537, 40/603, 604, 605, 615, 617

[56] References Cited

U.S. PATENT DOCUMENTS

| | | | |
|---|---|---|---|
| 1,343,569 | 6/1920 | Levy | 40/617 X |
| 1,467,680 | 9/1923 | Oda | 40/617 X |
| 2,322,713 | 6/1943 | Hirschhorn | 40/604 |
| 2,655,749 | 10/1953 | La Fontaine | 40/604 |
| 4,171,584 | 10/1979 | Kaiser | 40/10 D X |
| 4,458,435 | 7/1984 | Acherman | 40/537 X |

*Primary Examiner*—John Fox

*Attorney, Agent, or Firm*—Michael, Best & Friedrich

[57] ABSTRACT

A display banner functions to display a visual message having both an unchanging visual component and an additional visual component which needs to be changed from time to time. The banner includes a planar member adapted to carry the unchanging visual component of the message and further includes one or more transparent panels mounted over the planar member so as to form one or more display pockets. A plurality of display elements, carrying the changeable visual components of the message, are removably received in the display pockets and are visible through the transparent panels. By selectively positioning selected ones of the display elements within the display pockets, the changeable visual component of the visual message can be changed as desired.

20 Claims, 2 Drawing Sheets

DISPLAY BANNER

This application is a continuation of Ser. No. 07/348,152 which is, now abandoned, and a continuation of application Ser. No. 064,330, filed on June 19, 1987 now abandoned.

BACKGROUND OF THE INVENTION

This invention relates generally to display banners and, in particular, to display banners useful in the promotion of selected, particular products.

It is a well-known and widespread practice to seek increased retail sales by offering consumers various "specials" on selected items and goods. Typically, such specials offer the consumer a price reduction on specific items or goods when a specified quantity is purchased during the period the special is in effect. Because the reasons for offering a special are linked to such unforeseen variables as the need to relieve overstocked inventory, the need to meet competition, and the need to deplete stocks of closed-out items, the decision to offer a special is often made on short notice, and the exact terms of the special may not be decided until only moments before the special is offered. Accordingly, such traditional advertising media as newspapers, radio and television, wherein substantial time can be needed to allow for the preparation and dissemination of advertising messages, are often not the most effective means for informing consumers of the existence and terms of the special, particularly where the decision to offer the special is made on short notice.

One alternative to such conventional advertising media as newspapers, radio and television is the use of printed display banners for displaying visually perceived promotional material. Such banners not only have the advantage of being relatively economical, but are also easy to erect and take down, and are readily capable, if desired, of being located close to the particular items or goods being offered. However, despite these advantages, such banners, like other advertising media, can require substantial time for initial printing and distribution. This is particularly true when the banner is intended to fit within an overall marketing concept and is called upon to carry an elaborate or specialized visual image. Such banners do not always offer the capability of promptly informing consumers of the existence and terms of a special, particularly when the need to offer a special arises quickly.

In view of the foregoing, it is a general object of the present invention to provide a new and improved visual display banner.

It is a further object of the present invention to provide a new and improved visual display banner which provides the capability of quickly and accurately informing consumers of purchasing information which is subject to frequent change.

It is a still further object of the present invention to provide a display banner which can be readily altered to suit current conditions while remaining consistent with an overall marketing theme.

SUMMARY OF THE INVENTION

The invention is directed to a banner including a print carrying medium in the form of a planar sheet. A transparent panel is mounted over the planar sheet so as to form a display pocket having one side formed by the planar sheet and another side formed by the transparent panel. A display card is removably received in the display pocket and includes a display surface which is visible through the transparent panel when the display card is in the display pocket.

The invention is also directed to a display advertising system for displaying a visual advertising message formed of a substantially unchanging visual component and a selectively changeable visual component. The display advertising system includes a print carrying medium in the form of a planar sheet having the substantially unchanging visual component of the visual advertising message. The display advertising system further includes a transparent panel mounted over the planar sheet at the location of the selectively changeable component of the visual advertising message so as to form a display pocket having one side formed by the planar sheet and another side formed by the transparent panel. One or more display elements, having a plurality of differing visual displays usable in forming the selectively changeable visual component of the visual advertising message, are also included. The display elements are removably receivable in the display pocket such that only selected ones of the differing visual displays are visible through the transparent panel.

The invention is also directed to a display banner having a substantially rectangular print carrying medium in the form of a substantially planar sheet including a first substantially rectangular transparent panel having an upper edge, a lower edge, and a pair of side edges. The first transparent panel is fixed to the planar sheet along the lower edge and the side edges so as to form a display pocket having one side formed by the planar sheet, another side formed by the transparent panel, and an open end formed along the upper edge. A second substantially rectangular transparent panel, having an upper edge, a lower edge, and a pair of side edges, is provided and is fixed, along its upper and side edges, to the planar sheet so that the lower edge of the second transparent panel overlaps the open upper end of the display pocket while permitting access to the interior of the display pocket. A display card is removably receivable in the display pocket and has a display surface visible through the first transparent panel when the display card is in the transparent pocket.

BRIEF DESCRIPTION OF THE DRAWINGS

The features of the present invention which are believed to be novel are set forth with particularity in the appended claims. The invention, together with the further objects and advantages thereof, may best be understood by reference to the following description, taken in conjunction with the accompanying drawings, in the several figures of which like reference numerals identify like elements, and in which:

DESCRIPTION OF THE PREFERRED EMBODIMENT

Figures 2, 3, 4, 5:
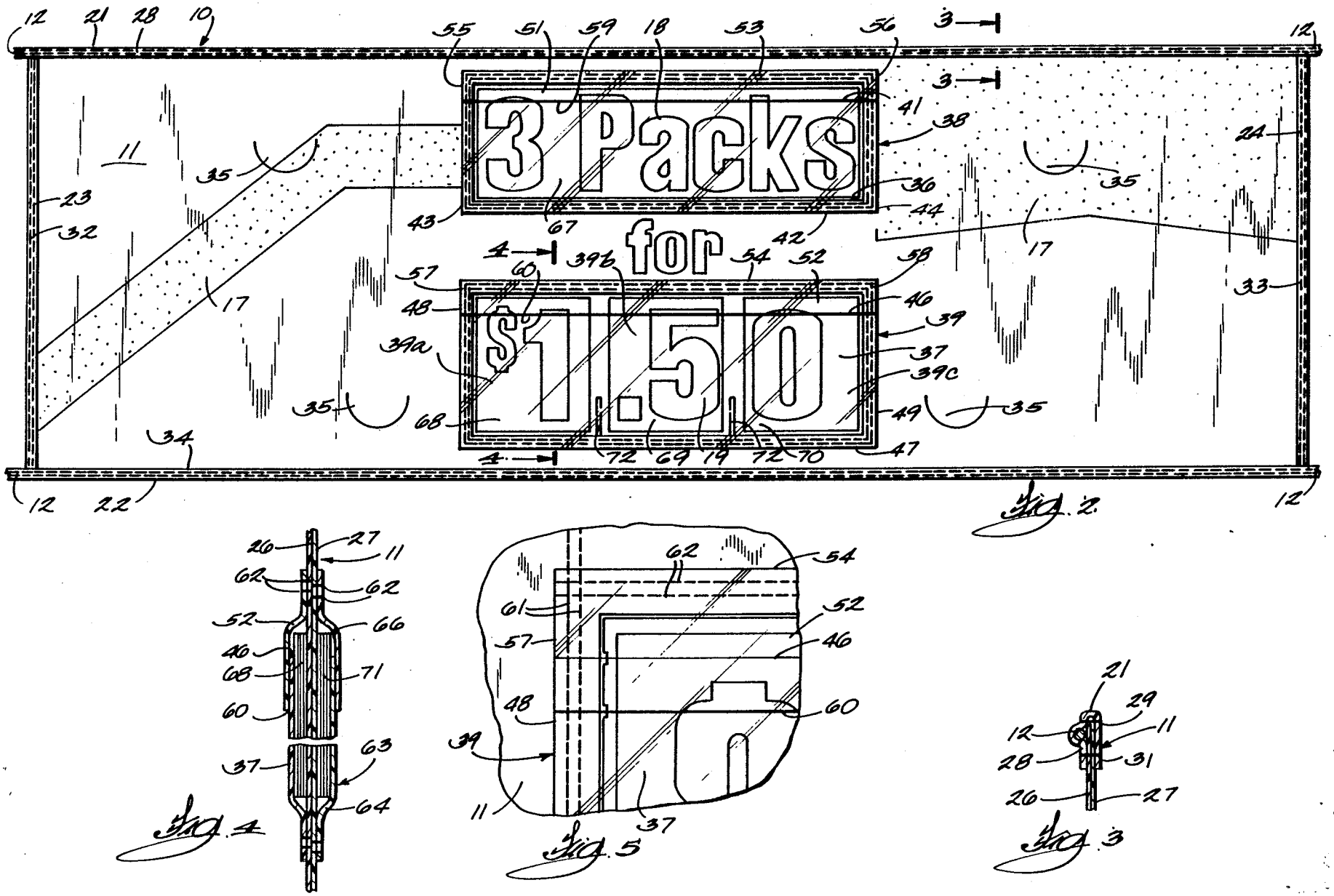
FIG. 2 is a front elevational view of the display banner illustrated in FIG. 1.
FIG. 3 is a cross-sectional view of the display banner shown in FIG. 2 taken along line 3—3 thereof.
FIG. 4 is a cross-sectional view of the banner shown in FIG. 2 taken along line 4—4 thereof.
FIG. 5 is a fragmentary view of one portion of the banner shown in FIG. 2 illustrating the construction of a display pocket.
Figure 1:
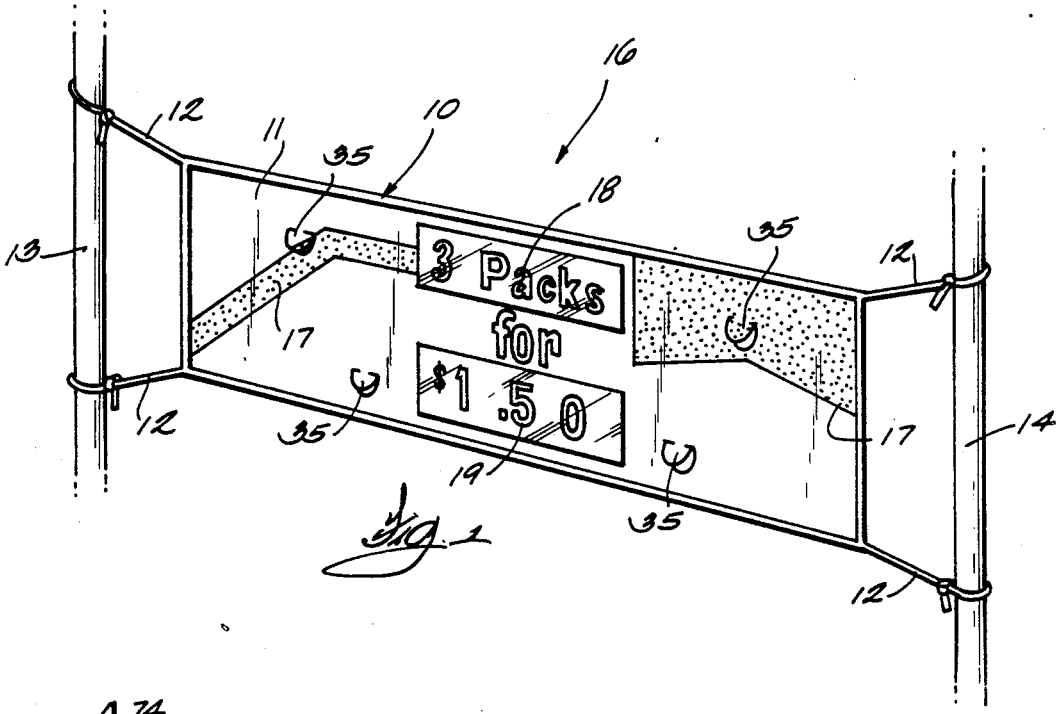
FIG. 1 is a perspective view of a display banner embodying various of the features of the invention.

Referring to the drawings, and in particular to FIGS. 1 and 2, a display banner 10 embodying various of the features of the invention is illustrated. As shown, the display banner 10 comprises a generally rectangular planar sheet 11 formed of a material, such as paper or plastic, which is suited to act as a medium for carrying a printed message. The planar sheet 11 is elongate in form, and the display banner 10 includes a support rope 12 extending from each of the four corners of the planar sheet 11 for supporting the planar sheet between a pair of supports 13 and 14.

As further illustrated in FIGS. 1 and 2, the display banner 10 forms part of a display advertising system 16 for displaying a visual advertising message having a substantially unchanging visual component together with a selectively changeable visual component. In the illustrated embodiment, the substantially unchanging visual component comprises a visual background 17, printed onto the planar sheet 11, and can include such matter as a product's name as well as any trademarks, logos, or slogans used in promoting the product. The selectively changeable visual component of the advertising message includes such items as a product quantity term 18 and product price term 19 either of which is subject to change on short notice.

The construction of the display banner 10 is best illustrated in FIGS. 2 through 5. As shown, the generally rectangular planar sheet 11 includes an upper edge 21, a lower edge 22, and a pair of side edges 23 and 24. Preferably, the planar sheet comprises a single, generally rectangular sheet which has been folded back upon itself along a crease line forming the upper edge 21 so that the resulting planar sheet 11 includes two substantially parallel layers 26 and 27 (FIG. 3), each forming an outwardly facing display surface on opposite sides of the banner 10. An elongate reinforcing strip 28, formed of flexible plastic or similar material, is folded over the upper edge 21 of the planar sheet 11, and is secured to the planar sheet 11 by means of a plurality of stitches 29 and 31 extending through both the folded reinforcing strip 28 and the two folded layers 26 and 27 of the banner 10. Preferably, one of the support ropes 12 extends along the entire length of the upper edge 21 of the planar sheet 11 and is secured to the planar sheet by being sandwiched between the reinforcing strip 28 and the planar sheet 11 and between the rows of stitches 29 and 31. Similar reinforcing strips 32 and 33 are stitched along the sides 23 and 24 respectively, while still another reinforcing strip 34 is stitched along the lower edge 22 of the planar sheet 11 to secure the other support rope 12 to the planar sheet 11 along the lower edge 22.

In order to avoid damage to the banner 10 or the supports 13 and 14 in the event the banner is used out-of-doors or is otherwise located in the wind, a plurality of semicircular cuts 35 are formed through the planar sheet 11 to permit air to pass therethrough and thereby reduce the wind resistance offered by the banner 10.

At the location of each selectively changeable component of the visual advertising message, the banner 10 includes a transparent panel mounted over the planar sheet. In the embodiment illustrated, a pair of upper and lower transparent panels 36 and 37, formed of flexible transparent plastic or similar material, are mounted over the planar sheet at the location of the product quantity term 18, and the product price term 19, respectively, so as to form a pair of upper and lower display pockets 38 and 39 each having one side formed by the planar sheet 11 and another side formed by the transparent panel 36 or 37. As illustrated, the upper transparent panel 36 is generally rectangular in form and includes an upper edge 41, a lower edge 42, and a pair of side edges 43 and 44. Similarly, the lower transparent panel 37 includes an upper edge 46, a lower edge 47, and a pair of side edges 48 and 49. Preferably, the side edges 43 and 44, and 48 and 49, together with the lower edges 42 and 47 of the upper and lower transparent panels 36 and 37, respectively, are each stitched to one layer 26 of the planar sheet 11 so that each of the display pockets 38 and 39 has an open upper end.

In order to prevent the entry of foreign matter into the display pockets 38 and 39 through their respective open upper ends, additional, substantially rectangular, transparent panels or cover flaps 51 and 52 are mounted on the planar sheet 11 and are positioned so as to overlap the upper edges 41 and 46, respectively, of the upper and lower transparent panels 36 and 37. Preferably, only the upper edges 53 and 54, and the side edges 55, 56 and 57, 58 of the cover flaps 51 and 52, respectively, are stitched to the planar sheet 11 so that access to the interior of the display pockets 48 and 49 can be achieved by lifting the lower edge 59 or 60 of either cover flap 51 or 52 upwardly and away from the open upper end of the display pocket 38 or 39 it overlaps.

Referring to FIG. 5, the transparent lower panel 37, together with the transparent cover flap 52, is positioned so that the lower edge 60 of the cover flap 52 extends somewhat below the upper edge 46 of the panel 37. Both the cover flap 52 and the transparent panel 37 are fixed to the planar sheet 11 by means of two rows of stitches 61 extending along their respective side edges 48 and 57. An additional row of stitches 62 secures the upper edge 54 of the cover flap 52 to the planar sheet 11. The cover flap 51 of the upper display pocket 38 is mounted to the planar sheet 11 in similar fashion.

Referring to FIG. 4, one or more additional display pockets 63 can be secured to the opposite side of the planar sheet 11 by stitching additional transparent panels 64 and 66 to the opposite layer 27 of the planar sheet 11. Such additional display pockets can be positioned substantially at the same location as the pockets on the one side of the banner, or, if desired, can be mounted at other locations.

In order to provide the selectively changeable visual component of the visual advertising message, the display banner 10 further includes one or more display elements or cards 67, 68, 69, 70 and 71 formed of paper, paperboard, or other printable material, each including a display surface or surfaces carrying a plurality of differing visual displays. In the embodiment illustrated, differing display cards are provided for each of the display pockets 38, 39 and 63. Each of the display cards 67, 68, 69, 70 and 71 is dimensioned to be removably receivable in one of the display pockets 38, 39 or 63 so as to be visible through the transparent panel of the pocket. If desired, a plurality of upwardly extending ridges 72 can be formed on the inside surface of any of the transparent panels to subdivide any of the display pockets, such as, for example, the lower display pocket 39, into a plurality of individual cells 39*a*, 39*b* and 39*c*. The display cards 68, 69 and 70 are then dimensioned to fit the resulting cells 39*a*, 39*b* and 39*c*.

As best shown in FIG. 2, the upper display card 67 can comprise a single rectangular sheet of paper, paperboard or similar material. Each side of the sheet can be provided with a printed visual display, and a plurality of such cards can be received in the upper display pocket 38. By arranging the cards so that a desired one of the various displays is visible through the transparent panel 36, the desired visual display can be achieved.

Figure 6:
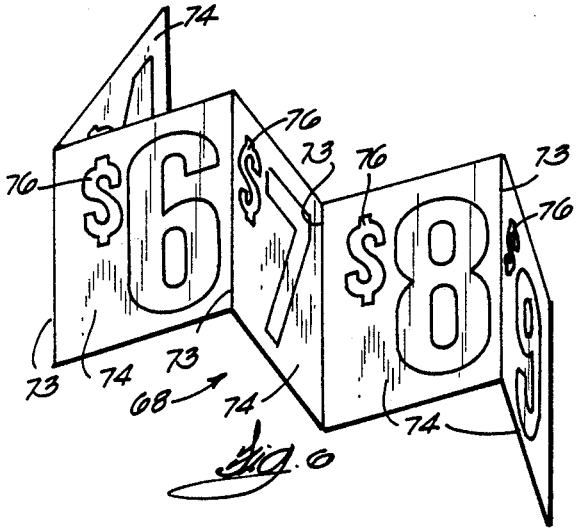
FIG. 6 is a perspective view of one embodiment of a display card forming a part of the banner shown in FIGS. 1 through 5.
Figure 7:
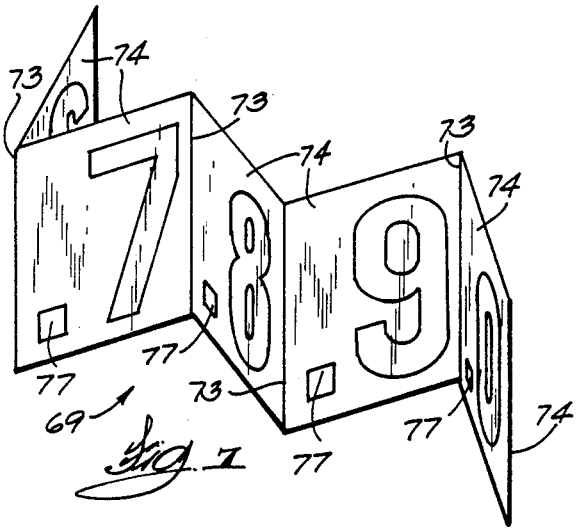
FIG. 7 is a perspective view of another embodiment of a display card usable with the banner shown in FIGS. 1 through 5.
Figure 8:
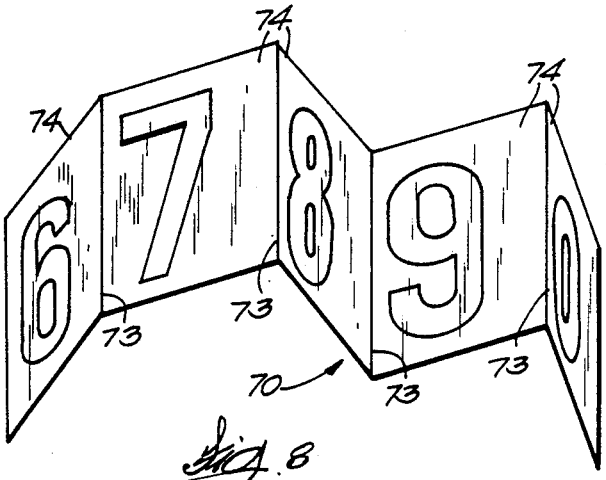
FIG. 8 is a perspective view of still another embodiment of a display card usable with the banner shown in FIGS. 1 through 5.

Referring to FIGS. 6 through 9, each of the remaining or lower display cards 68, 69 and 70 is dimensioned to be received in one of the three display cells 39*a*, 39*b* or 39*c* formed in the lower display pocket 39. In the embodiment shown, the lower display cards 68, 69 and 70 are arranged to permit the display of any price term in an amount less than $10.00. As shown in FIGS. 6 through 8, each of the display cards 68, 69 and 70 comprises an elongate strip of paper, paperboard, or other similar material, having a plurality of parallel, regularly spaced, fold or crease lines 73 formed perpendicularly to the elongate axis of the card and arranged such that the card can be folded down to a rectangular shape receivable in one of the display cells 39*a*, 39*b* or 39*c* of the display pocket 39. A display surface 74 is thus formed between each pair of creases 73, and differing visual displays are printed on each of the plurality of display surfaces 74 thus formed. By selectively folding the display card 68, 69 or 70, a desired one of the display surfaces 74 can be rendered visible through the transparent panel 37.

The display card 68 illustrated in FIG. 6 forms the first digit in the price term and includes the numerals 0 through 9, each preceded by a dollar sign 76. The display 69 illustrated in FIG. 7 forms the first digit after the decimal point in the price term and includes the digits 0 through 9, each preceded by a decimal point 77. The display card 70 shown in FIG. 8 forms the last digit in the price term and includes the digits 0 through 9 without any additional matter. It will be appreciated that, with three such display cards 68, 69 and 70, each having the described indicia printed thereon, any price term between $0.00 and $9.99 can be formed and displayed through the transparent panel 37 of the lower display pocket 39.

Figure 9:
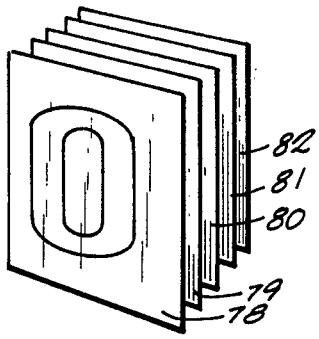
FIG. 9 is a perspective view of a set of alternative embodiment display cards usable with the banner shown in FIGS. 1 through 5.

FIG. 9 illustrates an alternative embodiment of display elements useful with the banner 10. In this embodiment, a plurality of two-sided, generally rectangular display cards 78, 79, 80, 81 and 82 are provided. Each of the cards 78–82 includes two display surfaces and a sufficient number of cards are included to encompass the range of desired indicia such as the numerals 0 through 9. When numbers are to be indicated, five cards 78–82, selectively having printed thereon the digits 0 through 9, are provided. By arranging the individual cards so that the desired digit is outermost, the desired visual display can be achieved. The unused cards can be placed behind the outermost card where they can be kept available for use in the event it is desired to change the display.

Although the invention has been described in terms of a particular visual display having both a quantity term and a price term, it will be appreciated that the invention is well suited for use wherever it is desired to combine a selectively changeable visual component with an unchanging visual component. Accordingly, it will be appreciated that the size, shape, number and position of the display pockets need not be precisely as illustrated and described herein, nor must the display cards be precisely as shown and described. Furthermore, it will be appreciated that the display on either side of the banner 10 can be the same, or, if desired, can be different.

While a particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

We claim:

1. A banner comprising:

a print carrying medium in the form of a planar sheet;

a transparent panel mounted over said planar sheet so as to form a display pocket having one side formed by said planar sheet and another side formed by said transparent panel;

said transparent panel being attached to said planar sheet around the periphery of said transparent panel but with a part thereof being free from said planar sheet to provide an opening for access to said display pocket;

a second panel having a position at the part of said transparent panel which is free from said planar sheet, said second panel being fixed to said planar sheet and having a portion thereof extending over and movable relative to said part of said transparent panel so that said second panel overlaps said part of said transparent panel which is free from said planar sheet to shield the interior of said display pocket against the entry of debris while permitting access to the interior of the display pocket, and a display card removably receivable in said display pocket through said opening and having a display surface visible through said transparent panel when said display card is in said display pocket.

2. A banner in accordance with claim 1 wherein said transparent panel is substantially rectangular in form having an upper edge, a lower edge, and a pair of side edges, and is fixed to said planar sheet along said lower and said side edges so that said display pocket includes an open upper end along said upper edge of said transparent panel.

3. A banner in accordance with claim 1 wherein said planar sheet is substantially rectangular in form and has an upper edge, a lower edge and a pair of side edges.

4. A banner in accordance with claim 1 wherein said display card comprises a single substantially planar sheet having a pair of opposite sides forming a pair of said display surfaces.

5. A banner in accordance with claim 1 wherein said display card comprises an elongate, substantially planar sheet folded along a plurality of substantially parallel fold lines so as to form a plurality of display surfaces between adjacent ones of said fold lines and such that a selected one of said display surfaces can be displayed by folding said display card so that said selected one of said display surfaces is outermost and visible through said transparent panel when said display card is in said display pocket.

6. The banner of claim 1 including means defining a plurality of slits in said planar sheet to permit air to pass therethrough the thereby reduce wind resistance offered by said banner.

7. A banner comprising:

a print carrying medium in the form of a planar sheet;

a transparent panel mounted over said planar sheet so as to form a display pocket having one side formed by said planar sheet and another side formed by said transparent panel;

a display card removably received in said display pocket and having a display surface visible through said transparent panel when said display card is in said display pocket; and said planar sheet comprising a substantially rectangular sheet folded substantially back upon itself along a crease line forming said upper edge of said planar sheet so that said planar sheet includes two substantially parallel layers of said print carrying medium, each of said layers forming an outwardly facing display surface on opposite sides of said planar sheet.

8. A banner in accordance with claim 7 wherein a pair of said transparent panels are mounted on opposite sides of said planar sheet so as to form a display pocket on either side of said planar sheet.

9. A display advertising system for displaying a visual advertising message formed of a substantially unchanging visual component and a selectively changeable visual component, said display advertising system comprising:

a print carrying medium in the form of a planar sheet having thereon the substantially unchanging visual component of the visual advertising message;

a transparent panel mounted over said planar sheet at the location of the selectively changeable component of the visual advertising message so as to form a display pocket having one side formed by said planar sheet and another side formed by said transparent panel;

said transparent panel being attached to said planar sheet around the periphery of said transparent panel but with a part thereof being free from said planar sheet to provide an opening for access to said display pocket;

a second panel positioned at said opening defined by said part of said transparent panel which is free from said planar sheet, said second panel being attached to said planar sheet and overlapping the portion of said transparent panel at said opening and being selectively movable relative to said part of said transparent panel so that said second panel overlaps said opening and shields said opening against the entry of debris while permitting access to the interior of said display pocket; and one or more display elements having thereon a plurality of differing visual displays usable in forming the selectively changeable visual component of the visual advertising message, such display elements being removably receivable in said display pocket through said opening such that only selected ones of said differing visual displays are visible through the transparent panel.

10. The banner of claim 9 including means defining a plurality of slits in said planar sheet to permit air to pass therethrough and reduce wind resistance offered by said banner.

11. A display advertising system for displaying a visual advertising message formed of a substantially unchanging visual component and a selectively changeable visual component, said display advertising system comprising:

a print carrying medium in the form of a planar sheet having thereon the substantially unchanging visual component of the visual advertising message;

a transparent panel mounted over said planar sheet at the location of the selectively changeable component of the visual advertising message so as to form a display pocket having one side formed by said planar sheet and another side formed by said transparent panel;

one or more display elements having thereon a plurality of differing visual displays usable in forming the selectively changeable visual component of the visual advertising message, such display elements being removably receivable in said display pocket such that only selected ones of said differing visual displays are visible through the transparent panel; and the changeable visual component of the visual advertising message includes a quantity specification and a price specification and wherein the display advertising system includes at least a pair of said transparent panels forming at least a pair of display pockets for respectively displaying the quantity specification and the price specification of the visual advertising message.

12. A display advertising system in accordance with claim 11 wherein at least one of said display elements includes the numerals 0 and 1 through 9 each arranged so as to be individually visible through said transparent panel when said display element is received in one of said display pockets.

13. A display advertising system in accordance with claim 11 wherein at least one of said display elements comprises an elongate, substantially rectangular, planar strip having a longitudinal axis and having a plurality of substantially parallel, evenly spaced, fold lines extending substantially perpendicular to said longitudinal axis and having said differing visual displays individually located between adjacent ones of said fold lines so that a selected one of said differing visual displays can be made visible through said transparent panel by folding said elongate strip such that said selected visual display is outermost and adjacent said transparent panel when said display element is received in one of said display pockets.

14. The banner of claim 11 including means defining a plurality of slits in said planar sheet to permit air to pass therethrough and reduce wind resistance offered by said banner.

15. A display banner comprising:

a substantially rectangular print carrying medium in the form of a substantially planar sheet:

a first substantially rectangular transparent panel having an upper edge, a lower edge, and a pair of side edges, said first transparent panel being fixed to said planar sheet along said lower edge and said side edges so as to form a display pocket having one side formed by said planar sheet, another side formed by said transparent panel, and an open end formed along said upper edge;

a second substantially rectangular transparent panel having an upper edge, a lower edge, and a pair of side edges, said second transparent panel being fixed to said planar sheet along said upper edge and said side edges of said second transparent panel so that said lower edge of said second transparent panel overlaps said open upper end of said display pocket to shield said open end against the entry of substantially downwardly falling debris while permitting access to the interior of the display pocket; and a display card removably receivable in said display pocket and having a display surface visible through said first transparent panel when said display card is in said display pocket.

16. A banner in accordance with claim 15 wherein said planar sheet comprises a substantially rectangular sheet folded substantially back upon itself along a crease line forming said upper edge of said planar sheet so that said planar sheet includes two substantially parallel layers of said print carrying medium, each of said layers forming an outwardly facing display surface on opposite sides of said planar sheet.

17. A banner in accordance with claim 16 wherein a pair of said transparent panels are mounted on opposite sides of said planar sheet so as to form a display pocket on either side of said planar sheet.

18. A banner in accordance with claim 15 wherein said display card comprises a single substantially planar sheet having a pair of opposite sides forming a pair of said display surfaces.

19. A banner in accordance with claim 15 wherein said display card comprises an elongate, substantially planar sheet folded along a plurality of substantially parallel fold lines so as to form a plurality of display surfaces between adjacent ones of said fold lines and such that a selected one of said display surfaces can be displayed by folding said display card so that said selected one of said display surfaces is outermost and visible through said transparent panel when said display card is in said display pocket.

20. The banner of claim 15 including means defining a plurality of slits in said planar sheet to permit air to pass therethrough and reduce wind resistance offered by said banner.

* * * * *